US006058756A

United States Patent [19]

Kutschker

[11] Patent Number: 6,058,756

[45] Date of Patent: May 9, 2000

[54] BENDING MACHINE

[75] Inventor: Wolfgang Kutschker, Boeblingen, Germany

[73] Assignee: Reinhardt Maschinenbu GmbH, Sindelfingen, Germany

[21] Appl. No.: 09/298,678

[22] Filed: Apr. 23, 1999

Related U.S. Application Data

[63] Continuation of application No. PCT/EP98/05145, Aug. 13, 1998.

[30] Foreign Application Priority Data

Aug. 26, 1997 [DE] Germany ..... 197 36 987

[51] Int. Cl.[7] ..... B21D 5/04

[52] U.S. Cl. ..... 72/319

[58] Field of Search ..... 72/319, 320, 322, 72/316

[56] References Cited

U.S. PATENT DOCUMENTS

| | | | |
|---|---|---|---|
| 387,746 | 8/1888 | Stark | 72/320 |
| 829,597 | 8/1906 | Ohl | 72/319 |
| 897,415 | 2/1908 | Rude | 72/320 |
| 1,527,547 | 2/1925 | Goeler | 72/319 |
| 4,449,389 | 5/1984 | Cros | 72/446 |
| 4,930,339 | 6/1990 | Corsini | 72/446 |

FOREIGN PATENT DOCUMENTS

| | | | |
|---|---|---|---|
| 2642677 | 8/1990 | France | 72/319 |
| 25 34 664 | 2/1977 | Germany . | |
| 303600 | 1/1929 | United Kingdom | 72/320 |
| 303677 | 1/1929 | United Kingdom | 72/320 |

*Primary Examiner*—Daniel C. Crane
*Attorney, Agent, or Firm*—Barry R. Lipsitz

[57] ABSTRACT

In order to improve a bending machine for flat material, comprising a machine frame, a lower beam with lower beam tool arranged on the machine frame and an upper beam with upper beam tool arranged on the machine frame, these beams being movable relative to one another for fixing the flat material in position, as well as a bending beam which has a bending beam tool receiving means adapted to be equipped with a bending beam tool and is held on the machine frame so as to be pivotable about an axis of rotation in order to bend the flat material fixed in position by the upper beam and the lower beam, such that a bowing of the bending beam tool is possible in as simple a manner as possible it is suggested that the bending beam tool receiving means be provided with an adjustable bowing device which supports a foot of the bending beam tool only in one section when seen in bending direction so that the foot abuts, in addition, essentially on a rear contact surface of the bending beam tool receiving means in a supported manner when the bending forces occur.

23 Claims, 7 Drawing Sheets

38
128
121
42
30
122
118
112
110
124
120
114
126
116
52
62
44R
58
60

138
132
134
136a
130
142
140
58
136b
48

BENDING MACHINE

This application is a continuation of the subject matter disclosed in International Application No. PCT/EP98/05145 of Aug. 13, 1998, the entire specification of which is incorporated herein by reference.

The invention relates to a bending machine for flat material, comprising a machine frame, a lower beam with lower beam tool arranged on the machine frame and an upper beam with upper beam tool arranged on the machine frame, these beams being movable relative to one another for fixing the flat material in position, as well as a bending beam which has a bending beam tool receiving means adapted to be equipped with a bending beam tool and which is held on the machine frame so as to be pivotable about an axis of rotation in order to bend the flat material fixed in position by the upper beam and the lower beam.

Such a bending machine is known from the state of the art. In the case of such bending machines there is the problem of the bending beam sagging in its longitudinal direction on account of its length and the loads occurring during the bending of the flat material and of this sagging having to be compensated by a so-called bowing of the bending beam tool.

A bowing of the bending beam tool is to be understood as a curvature of the bending beam tool in longitudinal direction of the bending beam, wherein the curvature is the most in the region of the center of the bending beam and decreases towards the two ends of the bending beam.

Such a bowing of the bending beam tool can be taken into consideration during its production, wherein this bowing is then, however, exact only for a certain load, i.e., one type of flat material with a specific thickness and in all other cases, in which the force on the bending beam is greater or smaller or distributed differently, is not suitable.

The object underlying the invention is therefore to improve a bending machine of the generic type in such a manner that a bowing of the bending beam tool is possible in as simple a manner as possible.

This object is accomplished in accordance with the invention, in a bending machine of the type described at the outset, in that the bending beam tool receiving means is provided with an adjustable bowing device which supports a foot of the bending beam tool only in one section when seen in bending direction so that the foot abuts, in addition, essentially on a rear contact surface of the bending beam tool receiving means in a supported manner when the bending forces occur.

The advantage of the inventive solution is to be seen in the fact that as a result of the support of the foot of the bending beam tool only in one section, on the one hand, the bowing device can be of a relatively small construction, in particular, narrow when seen in bending direction and, furthermore, an advantageous support of the bending beam tool results at the parts of the bending beam which are in a position to absorb considerable forces.

Alternatively or supplementarily, one advantageous embodiment of the inventive solution provides for the foot to experience during the occurrence of the bending forces while tilting about a contact surface formed by the bowing device a momentum which causes the foot to abut on the contact surface of the bending beam tool receiving means to the rear in bending direction.

A particularly favorable solution with respect to the introduction of the bending forces into the bending beam which can be achieved provides for the bowing device to support the foot of the bending beam tool in a region to the front in relation to the bending direction.

In this respect, it is preferably provided for this front region to be a front edge region of the bending beam tool.

A favorable solution which is advantageous, in particular, with respect to the desired distribution of force in the bending beam provides for the region of the foot supported by the bowing device to be arranged at a distance from a contact surface of the bending beam tool receiving means to the rear in relation to the bending direction.

With respect to the type of bending beam tool, no further details have been given in conjunction with the aforementioned development of the individual solution examples. It would be conceivable, for example, to use a continuous bending rail as bending beam tool.

It is, however, particularly advantageous for complicated bending tasks which have to be defined exactly when the bending beam tool comprises at least one bending beam tool segment. Preferably, several bending beam tool segments are used in order to construct the bending beam tool as such.

When using bending beam tool segments, it would be conceivable to also provide these with a slight bow so that the distance between foot and bending surface would be different for different bending beam tool segments. As a result, these bending beam tool segments could-be used only at a specific position. For this reason, the bending beam tool segments are preferably designed to be bow-free, i.e. the distance between foot and bending surface is identical for all the bending beam tool segments.

With respect to the bowing device itself, no further details have been given in conjunction with the preceding explanations concerning the inventive solution. For example, one advantageous solution provides for the bowing device to have a first adjusting element which is movable in the direction towards the pivot axis and has an adjustably bowable bearing surface for the foot of the bending beam tool.

In this respect, it is preferably provided for the first adjusting element to interact with a second adjusting element and for the bowing of the bearing surface of the first adjusting element to be adjustable as a result of a movement of the adjusting elements relative to one another.

In this case, an adjustability of the second element is provided, in particular, in that this is movable in a direction parallel to the pivot axis.

In order to design the bowing of the bearing surface so as to be adjustable, it is preferably provided for the adjusting elements to have adjusting surfaces abutting on one another, the inclination of these surfaces being small in a region, in which a slight bowing is intended to be generated, and is greater towards the region, in which a greater bowing is intended to be brought about.

In this respect, the first adjusting element forming the bearing surface is preferably built up from several segments which are arranged between guide members guiding these segments in an adjusting direction transverse to the pivot axis.

The individual segments together thereby form the bearing surface for the bending beam tool or the bending beam tool segments, wherein as a result of the adjustability of the bowing of the bearing surface the bowing of the bending beam tool resting on this or of the bending beam tool segments can also be adjusted.

With respect to the design of the adjusting elements themselves it is preferably provided for the first adjusting element to have a thickness corresponding approximately to the extension in bending direction of the region of the support surface resting on the bearing surface.

It is particularly advantageous when both adjusting elements have such a thickness.

This creates the possibility of building up the bowing device from structural parts which are thin when seen in bending direction and are extremely simple to produce.

These structural parts with a thickness of the adjusting elements corresponding approximately to the extension of the supported region of the support surface may be designed to be particularly simple to produce.

One advantageous development provides for the adjusting surfaces of at least one of the adjusting elements, which are difficult to machine on account of their geometry, to be produced from a piece of flat material by laser or water jet cutting.

Furthermore, one embodiment of the inventive solution which is improved even further provides for a guide surface of the second adjusting element to be produced by way of laser or water jet cutting.

In order, in addition, to produce the additional adjusting element which has the bearing surface as simply as possible with respect to its contour, it is preferably provided for the bearing surface of the first adjusting element to be produced by way of laser or water jet cutting.

All the surfaces produced by way of laser or water jet cutting are, in particular, arranged at narrow sides of the adjusting elements designed like strips and have, on account of the special production process, surfaces which are slightly curved but designed more as linearly supporting surfaces transversely to the longitudinal direction of the adjusting elements.

With such a production method, the adjusting surfaces, which can be produced only with considerable resources on account of the difficult geometry of the other processes, may be produced particularly inexpensively and simply in relation to the guide surface and to the bearing surface.

In this respect, it is preferably provided for the adjusting surfaces to be designed in the shape of teeth and for a center of each individual adjusting surface to have the same respective distance from the guide surface and the bearing surface, respectively.

With respect to the fixing in position of the bending beam tool in the bending beam tool receiving means, no further details have been given in conjunction with the preceding explanations concerning the individual embodiments. One advantageous embodiment, for example, provides for the bending beam tool receiving means to have a fixing device for the bending beam tool.

In this respect, it would be possible, for example, to design the fixing device such that each individual bending beam tool segment is to be fixed in a complicated manner, for example, with a setscrew or the like. A particularly favorable solution does, however, provide for the fixing device to be activatable, for example, actuatable with a medium subject to pressure. As a result, the fixing device may be activated in the simplest manner and thus transferred into a position fixing the bending beam tool and releasing the bending beam tool.

In order to be able to hold the bending beam tool in the bending beam tool receiving means in a suitable manner, it is preferably provided for the fixing device not only to contribute to the fixing in position of the bending beam tool in the bending beam tool receiving means but also to serve to act on the bending beam tool in the direction of the bearing surface of the bowing device. In this case, it is preferably provided for the fixing device to act on the bending beam tool with an inclined surface in the direction of the bearing surface in order to cause all the bending beam tool segments to abut securely on this.

A particularly favorable solution provides for a fixing member of the fixing device to be acted upon by the medium subject to pressure.

Such a medium subject to pressure could, for example, act on a cylinder and this, for its part, on the fixing member.

A solution which is considerably more simple from a constructional point of view provides for the fixing device to have a pressure element which extends in longitudinal direction thereof and has an elastically flexible wall so that any action on the pressure element by means of the medium subject to pressure leads to action on the fixing member in the direction of an engagement in the foot of the bending beam tool.

A particularly expedient solution provides not only for a continuous fixing member but also a division thereof into individual fixing member segments in order to attain a better compensation for tolerances, an even distribution of force and, in particular, a better fixing in position of individual bending beam tool segments.

Additional features and advantages of the invention are the subject matter of the following description as well as the drawings illustrating several embodiments.

In the drawings:

FIGS. 4 and 5 show an enlarged, detailed illustration in longitudinal extension of an inventive bowing device, wherein FIG. 4 shows the position without any bowing and FIG. 5 the position with considerable bowing;

Figure 1:
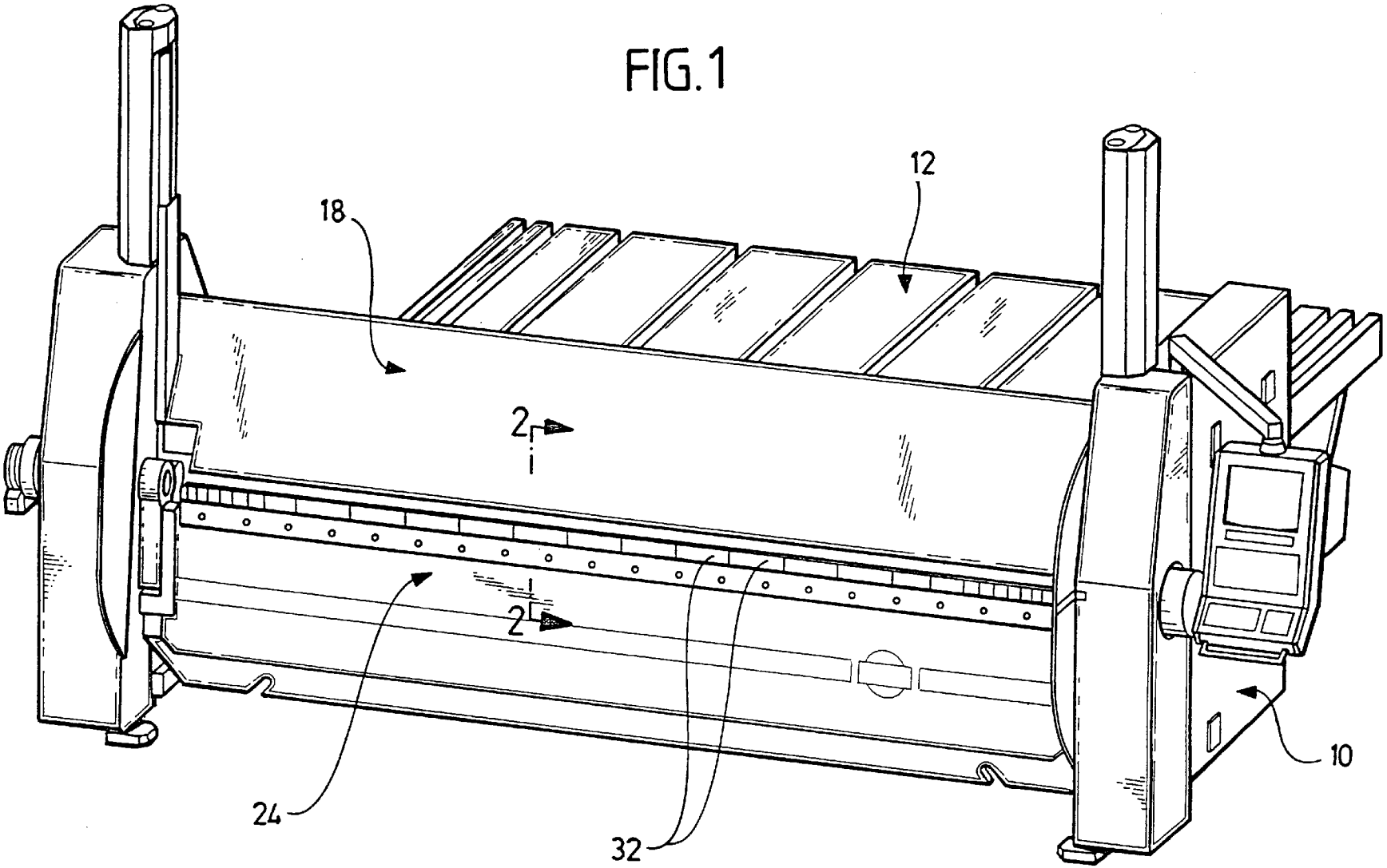
FIG. 1 shows a perspective view of an inventive bending machine for flat material.

One embodiment of an inventive bending machine, illustrated as a whole in FIG. 1, comprises a machine frame 10, on which a supporting table 12 for a sheet of flat material to be bent is held.

Figure 2:
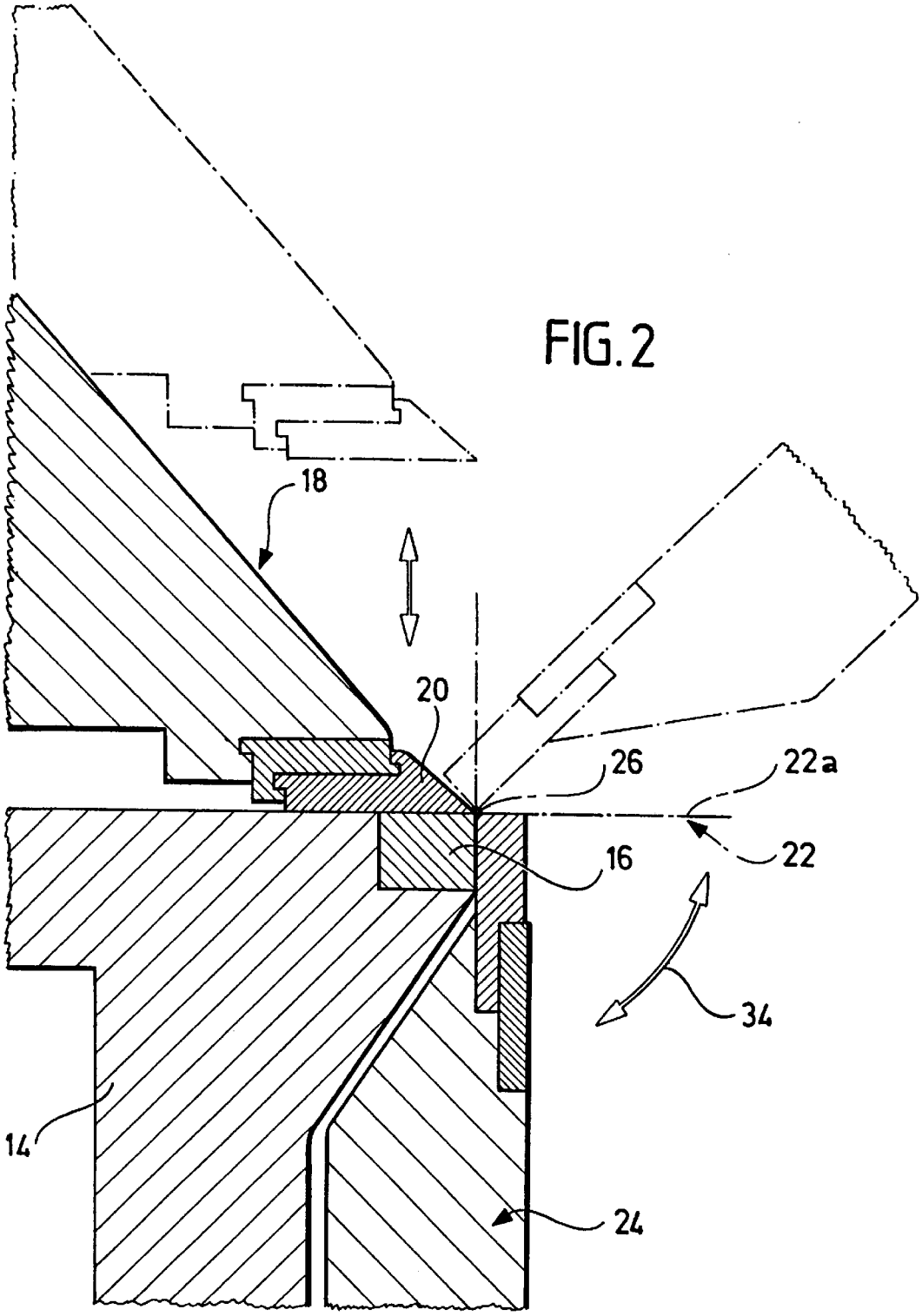
FIG. 2 shows a section along line 2—2 in FIG. 1 in the region of lower beam tool, upper beam tool and bending beam tool.

Furthermore, a lower beam 14 not visible in FIG. 1 but illustrated in FIG. 2 is arranged stationarily on the machine frame 10 and bears a lower beam tool 16.

Located opposite the lower beam 14 is an upper beam 18 which bears, for its part, an upper beam tool 20.

A sheet of flat material 22 which is illustrated by dash-dot lines in FIG. 2 and can be placed on the supporting table 12 can be fixed in position with the lower beam tool 16 and the upper beam tool 20, wherein a section 22*a* to be bent over projects laterally beyond the lower beam 14 and the upper beam 18 on a side located opposite the supporting table 12.

In order to bend the protruding section 22*a*, a bending beam designated as a whole as 24 is mounted on the machine frame 10 so as to be pivotable about a pivot axis 26, wherein the pivot axis 26 extends approximately in the center point of the radius of the bend to be attained and thus parallel to a bending line. In this respect, the pivot axis 26 may extend through the sheet of flat material 22 fixed in position by the lower beam 14 and the upper beam 18 or be located next to it and extend parallel to it.

In order to move the bending beam 24, a pivot drive not illustrated in FIG. 1 is provided in addition on the machine frame 10.

Figure 3:
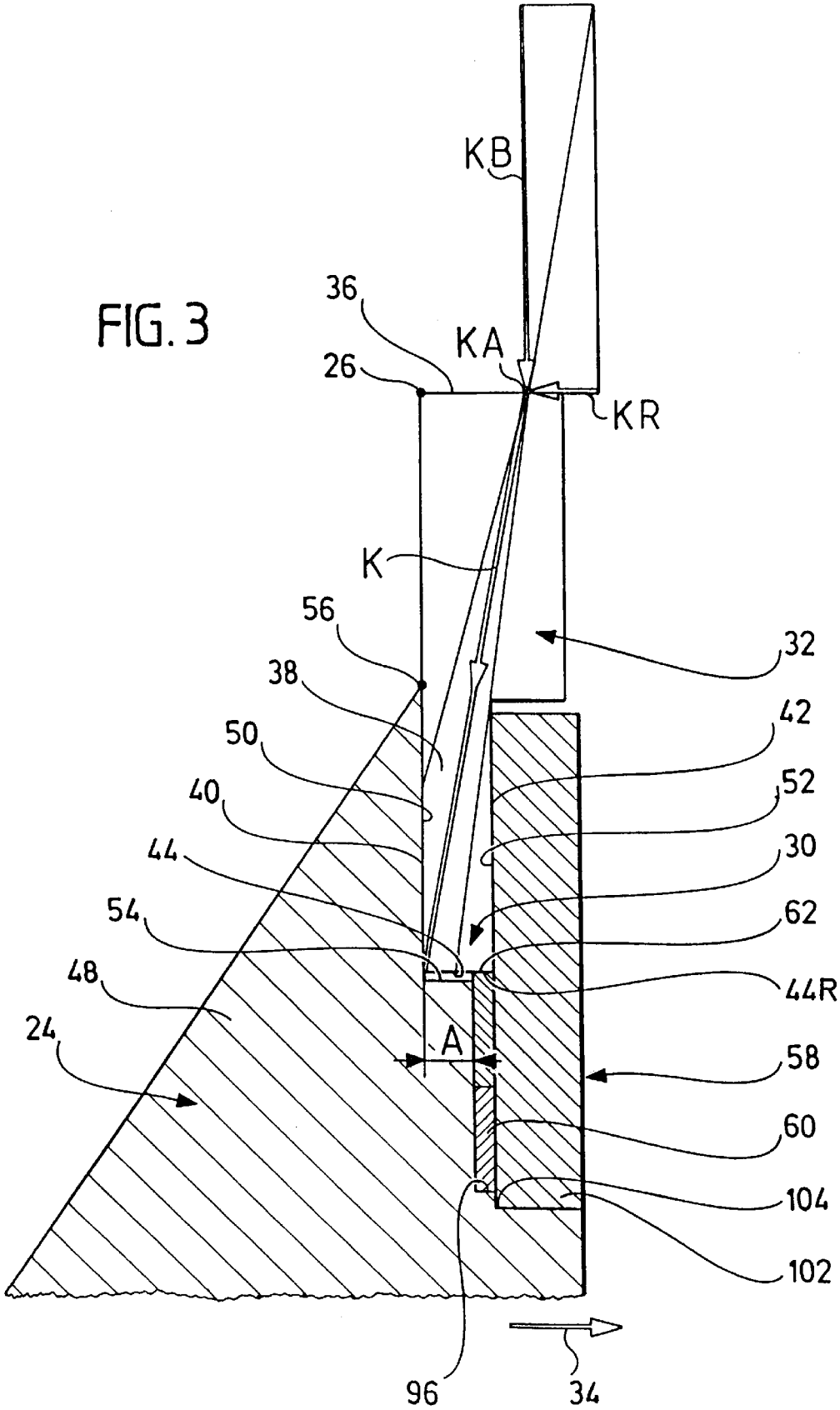
FIG. 3 shows an enlarged illustration of the section in FIG. 2 showing geometrical and force relationships.

In FIG. 2 and again illustrated in FIG. 3 on an enlarged scale, the bending beam 24 is provided with a bending beam tool receiving means which is designated as a whole as 30 and into which bending beam tool segments 32, which are also illustrated in FIG. 1, can be inserted.

In order to bend the protruding section 22*a* of the sheet of flat material 22, the bending beam 24 together with the bending beam tool segment 32 or several bending beam tool segments 32 is movable in a bending direction 34 about the pivot axis 26, wherein the bending beam tool segment 32 acts on the protruding section 22*a* of the sheet of flat material 22 with a bending surface 36 located close to the pivot axis 26.

The bending beam tool segment 32 is fixed in position in the bending beam tool receiving means 30 by a foot of the bending beam tool segment 32 which comprises a foot member 38, dips into the bending beam tool receiving means 30 and can be fixed in position therein.

The foot member 38 has a rear support surface 40 located on a side thereof to the rear in the bending direction 34, a support surface 42 to the front when seen in the bending direction 34 and a lower support surface 44.

The rear support surface 40 preferably faces an upper region of a bending beam member 48 which, for its part, bears a contact surface 50, onto which the rear support surface can abut, wherein the contact surface 50 is a side wall of a recess L-shaped in cross section in the upper region of the bending beam member 48, this side wall extending in continuation of a base surface 54 of the recess as far as an upper edge 56.

The lower support surface 44 of the foot member 38 does face the base surface 54 but, preferably, does not rest on this, as will be described in greater detail in the following.

The front support surface 42 located opposite the rear support surface 40 faces a front contact surface 52 which is part of a holding rail 58 held at the upper region of the bending beam member 48.

The foot member 38 is supported in the region of its lower support surface 44 by a bowing device which is designated as a whole as 60 and has an upper bearing surface 62 which is arranged at a distance A from the rear contact surface 50, for example, formed by the upper region of the bending beam member 48 and thereby acts on the lower support surface 44 only in an edge region 44R arranged at the distance A from this rear contact surface in bending direction 34 so that the foot member 38 is not supported in the region of the lower support surface 44 which is located between the edge region 44R and the support surface 40.

During bending of the sheet of flat material 22 with the bending beam tool segment 32, a force K acting on this bending beam tool segment 32 now occurs, as illustrated in FIG. 3, and this force consists of a component KB, which extends parallel to a radial direction of the pivot axis 26, and a component KR, which extends in the opposite direction to the bending direction 34. In the case of a flat material 22 extending over the width of the bending surface 36 of the bending beam tool segment 32, a force application point is located at approximately two thirds of the extension of the bending surface 36 in the bending direction 34 proceeding from the pivot axis 26.

As a result of the force K acting on the bending beam tool segment 32, the foot member 38 thereof is acted upon, on the one hand, such that it abuts on the upper edge 56 of the rear contact surface 50 and is supported on the bearing surface 62 with the edge region 44R of the lower support surface 44 so that the force is essentially introduced into the bending beam 24 in these two regions.

On account of the fact that the essential component of the force K is the component KR, a support takes place primarily on the bearing surface 62 of the bowing device 60 and then on account of a tilting moment occurring around an axis of tilt extending through the bearing surface 62 an abutment of the rear support surface 40 on the contact surface 50, in particular, in the region of the upper edge 56 thereof.

In this respect, it is essential that the force K occurring during bending does not have any appreciable component acting on the holding rail 58 and thus act upon it.

For this purpose, the force K is directed, proceeding from the force application point KA located at approximately two thirds of the extension of the bending surface 36 in bending direction 34, such that the vector thereof is directed onto a region of the bending beam tool receiving means which is located between the contact surface 62 and the upper edge 56.

Figure 4:
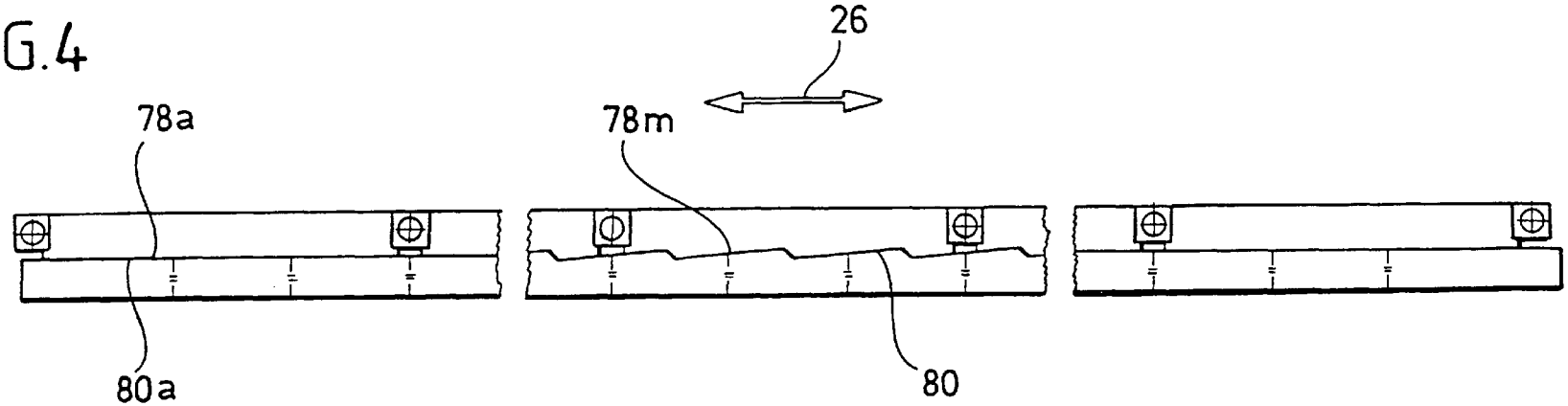
Figure 5:
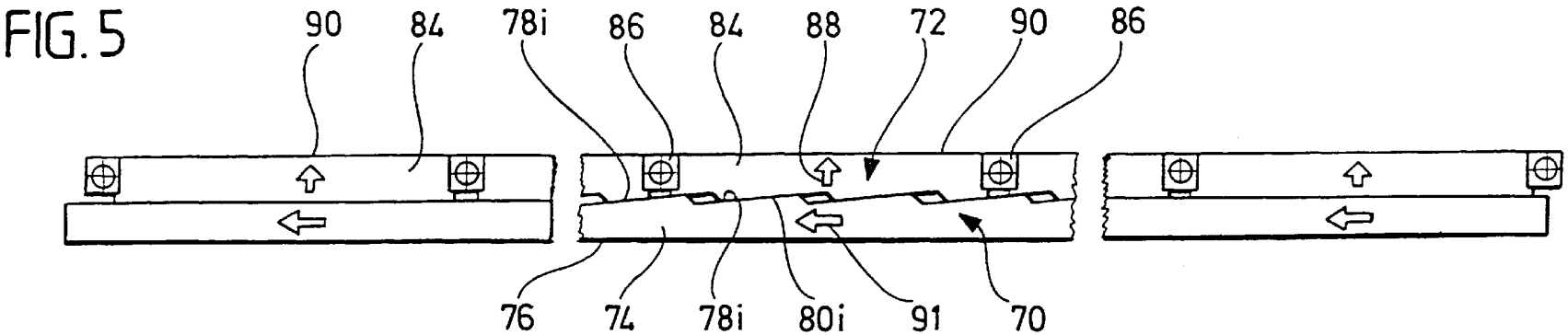
Figure 6:
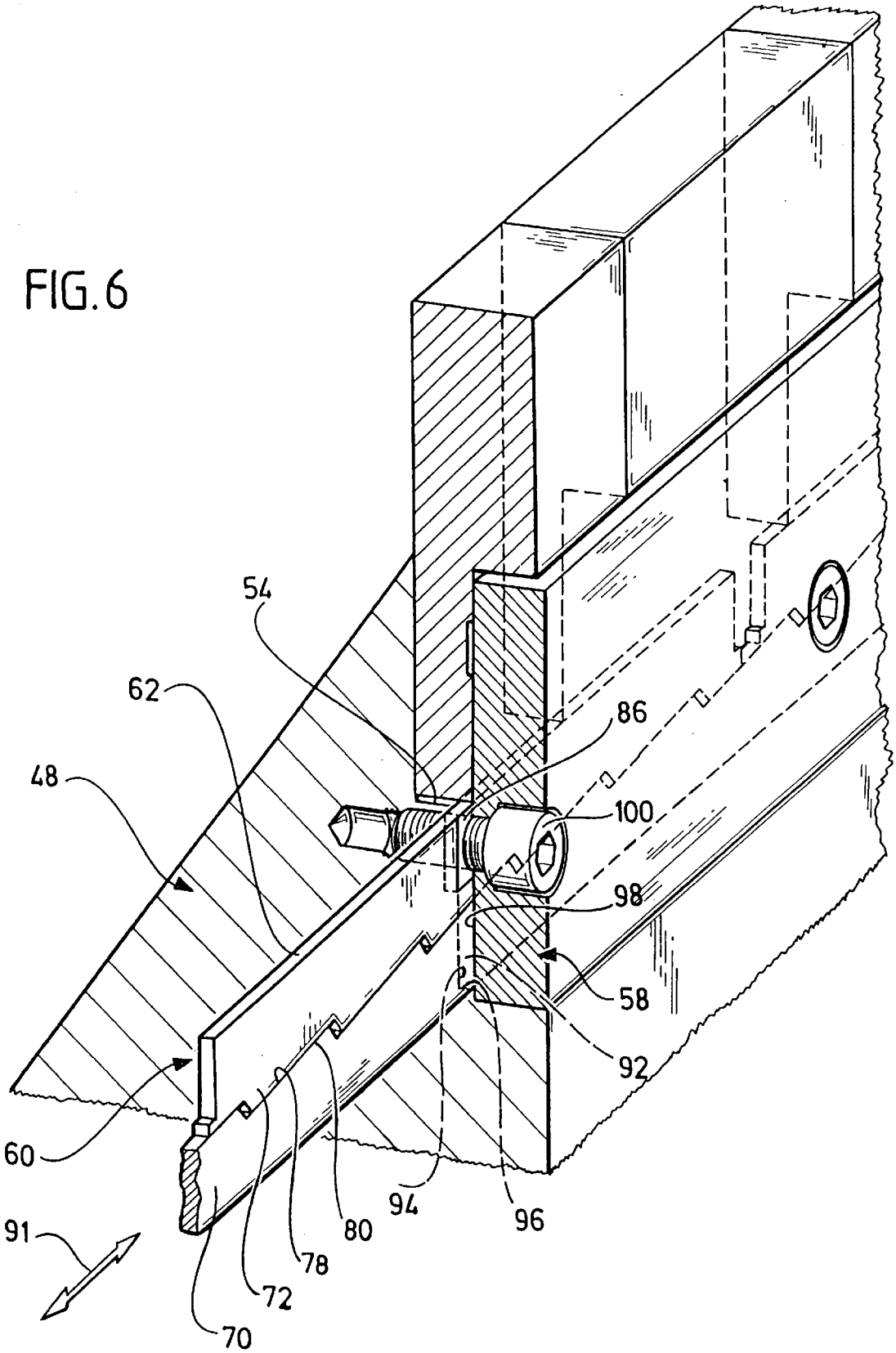
FIG. 6 shows a perspective illustration of the section similar to FIG. 2 with a likewise perspective illustration of parts of the bowing device.

The bowing device designated as a whole as 60 comprises, as illustrated in FIGS. 4, 5 and 6, two interacting adjusting elements 70 and 72, wherein one of the adjusting elements, for example, the lower adjusting element 70 has a strip member 74 extending parallel to the pivot axis 26, this member being provided, on the one hand, with a guide surface 76 and, on the other hand, with a plurality of adjusting surfaces 78, wherein outer adjusting surfaces 78*a* each have a smaller inclination in relation to the guide surface 76 than inner adjusting surfaces 78*i* but with all the adjusting surfaces the distance of a center 78*m* of an adjusting surface from the guide surface 76 is identical.

The adjusting element 72 likewise has a plurality of adjusting surfaces 80 located opposite the adjusting surfaces 78, wherein the outer adjusting surfaces 80*a* likewise have, corresponding to the outer adjusting surfaces 78*a*, a smaller inclination than inner adjusting surfaces 88*i*, corresponding to the inner adjusting surfaces 78*i* of the lower adjusting element 70.

In this respect, the inclination of the adjusting surfaces 78, 80 abutting on one another is identical.

The upper adjusting element 72 is preferably subdivided into individual segments 84, wherein each segment 84 is located between two guide members 86 and is secured by these against any movement in the direction of the pivot axis 26 but guided such that the segments 84 can carry out a movement transversely to the pivot axis 26 in an adjusting direction 88.

Each individual segment 84 of the upper adjusting element 72 bears on its side located opposite the adjusting surfaces 80 one section 90 of the bearing surface 62 extending in the direction of the pivot axis 26 so that all the sections 90 of all the segments 84 result in the bearing surface 62.

The individual segments 84 are adjustable due to movement of the lower adjusting element 70 in an activation direction 91 parallel to the pivot axis 26 since the adjusting surfaces 78 slide relative to the adjusting surfaces 80 of the segments 84 non-displaceable in the direction of the pivot axis 26 and thus when the adjusting element 70 is supported on the guide surface 76 displace each individual segment 84 in the adjusting direction 88 but to a varying degree, namely in accordance with the respective inclination of the interacting adjusting surfaces 78 and 80 which—as already described—becomes increasingly greater from outer regions of the adjusting elements 70 and 72 towards inner regions when seen in the direction of the pivot axis 26 and a maximum is reached in the center of the two adjusting elements 70 and 72 so that, as illustrated in FIG. 5, the bearing surface 62 as a whole is given a bow, i.e. is curved in an arc shape in the direction of the pivot axis 26 and towards the pivot axis 26. The bowing is thereby, in relation to a length of the bending beam 24 of in the order of magnitude of three meters, in the range of a few tenths of a millimeter, at the most up to a few millimeters, by which the bearing surface 62 has in the center a greater distance from the guide surface 76 than at the outside.

The adjusting elements 70 and 72 are, as illustrated in FIGS. 3 and 6, arranged in an intermediate space 92 formed by a recess which is L-shaped in cross section, adjoins the base surface 54 on a side facing away from the foot member 38 and is open towards the holding rail 58. The L-shaped recess comprises a side wall 94 and a base 96 which extends between the side wall 94 and an inner wall 98 of the holding rail 58 located opposite the side wall 94.

The two adjusting elements 70 and 72 are guided with clearance in this intermediate space 92, particularly between the side wall 94 and the inner wall 98, and the adjusting element 70 rests with its guide surface 76 on the base 96 and is supported on this.

The adjusting elements 70 and 72 rise above the base 96 to such an extent that the bearing surface 62 formed by the adjusting element 72 protrudes beyond the base surface 54 and thus acts on the lower support surface 44 only in its edge region 44R so that a small free space remains between the remaining part of the lower support surface 44 and the base surface 54.

The holding rail 58 is preferably secured to the upper region of the bending beam member 48 by means of screws 100, wherein the screws 100 pass through the guide members 86 and engage in the bending beam member 48. The guide members 86 thus serve at the same time as spacer elements for the exact positioning of the holding rail 58 which, in addition, rests with an end region 102 facing away from the bending beam tool segment 32 on a step 104 formed by the upper region of the bending beam member 48 and adjoining the intermediate space 92.

The adjusting element 70 is thus displaceable in the activation direction 91 and rests with its strip member 74 on the base 96 of the intermediate space 92. In addition, the individual segments 84 of the adjusting element 72 are movable in the adjusting direction 88 in order to adjust the bowing for the respective bending beam tool segment 32.

Figure 7:
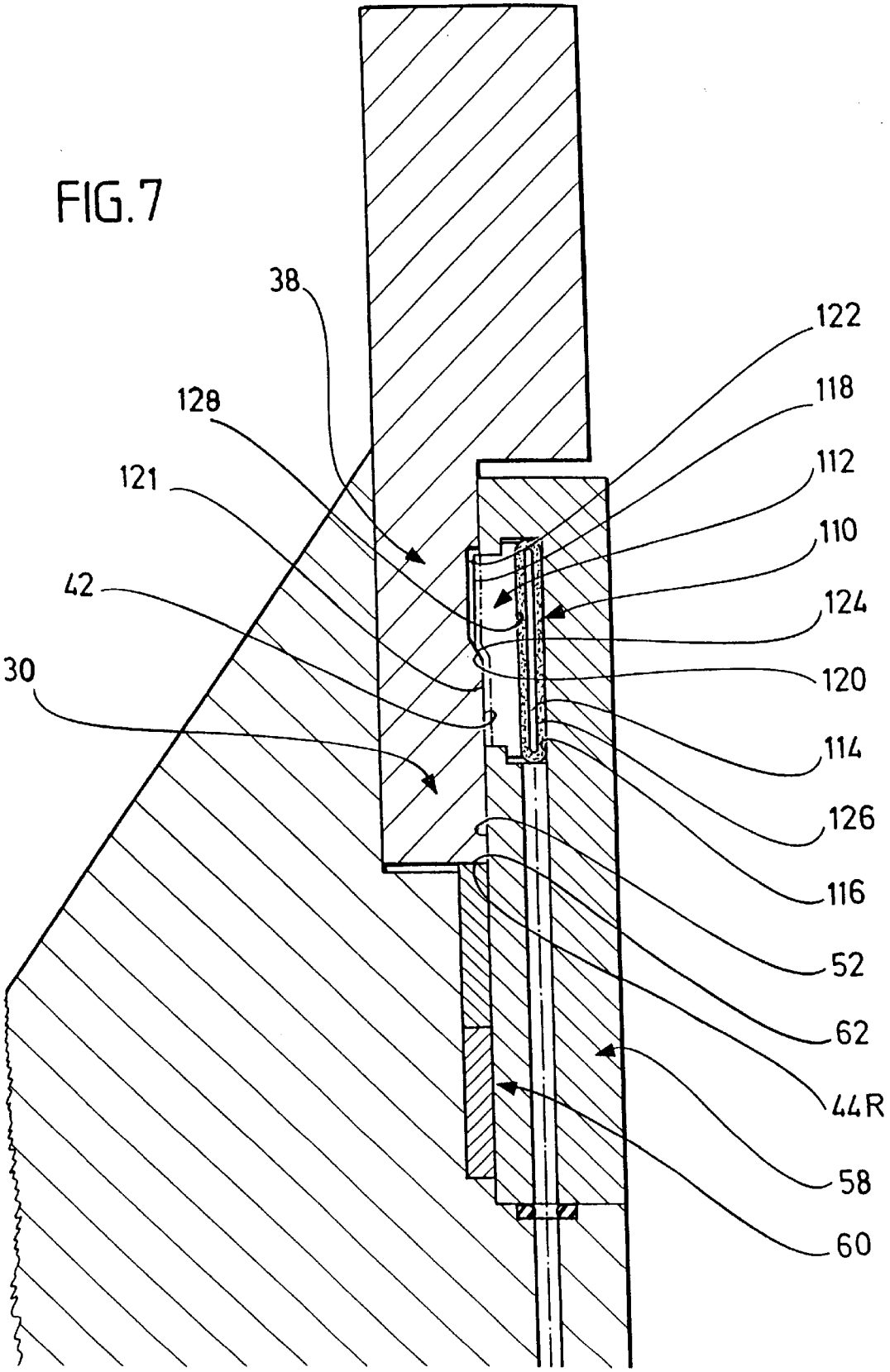
FIG. 7 shows a section similar to FIG. 3 through a second embodiment and FIG. 8 shows a section similar to FIG. 7 through the second embodiment in the region of a supply to a pressure element of a fixing device illustrated in FIGS. 7 and 8.
Figure 8:
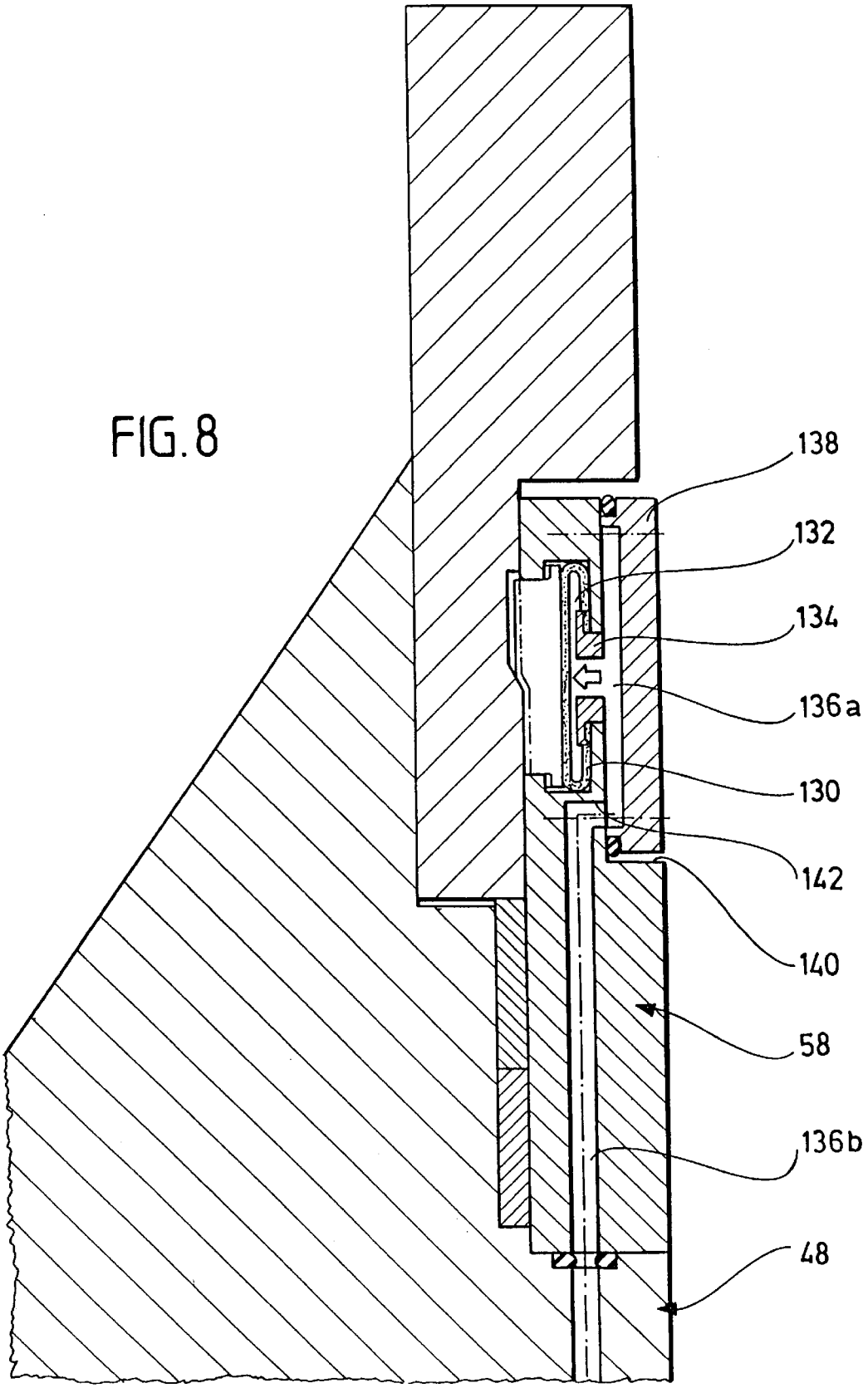

In order to be able to fix the individual bending beam tool segments 32, which dip with their foot member 38 into the bending beam tool receiving means 30, in position in a simple manner, a fixing device designated as a whole as 110 is provided, as illustrated in FIGS. 7 and 8, and this has a fixing member 112 and a pressure element 114, with which the fixing member 112 can be acted on, wherein the fixing member 112 is preferably built up from individual fixing member segments.

The fixing member 112 and the pressure element 114 are arranged in a recess 116 in the holding rail 58 such that the fixing member 112 protrudes beyond the front contact surface 52 with an elevation 118 in the state acted upon by the pressure element 114.

The elevation 118 of the fixing member 112 is adjoined on a side facing the base surface 54 of the bending beam tool receiving means 30 by an inclined surface 120, with which the elevation 118 slopes down towards a surface 121 of the fixing member which is aligned approximately with the front contact surface 52 when acted upon with the pressure element 114.

The foot member 38 is, for its part, preferably provided with a recess 122 which is arranged at the level of the elevation 118 so that when the fixing member 112 is acted upon by the pressure element 114 the elevation 118 engages in the recess 122 and thus secures the foot member 38 first of all against any removal out of the bending beam tool receiving means 30. Furthermore, the inclined surface 120 abuts on a corresponding inclined surface 124, with which the recess 122 merges into the front support surface 42 of the foot member 38. As a result, the foot member 38 is acted upon, in addition, in the direction of the base surface 54 of the bending beam tool receiving means 30 and thus abuts against the contact surface 62 of the bowing device 60 with its edge region 44R.

The pressure element 114 provided for acting on the fixing member 112 rests on a base surface 126 of the recess 116 and between this and a base surface 128 of the fixing member 112 facing the base surface 126 and is thus in a position to act on the fixing member 112 in the direction of the foot member 38 as a result of a change in volume. The pressure element 114 is, as again clearly illustrated in FIG. 8, formed from a tubular member 130 consisting of an elastic material which has an inner hollow space 132. A medium is provided in this inner hollow space and can be acted upon with pressure via a connection sleeve 134 which communicates with a supply channel 136 so that the pressure element 114 moves the fixing member 112 in the direction of the foot member 38, depending on whether the supply channel 136 is acted on with pressure or not.

The supply channel 136 preferably extends from the sleeve 134 first of all in a cover bar 138 and then merges into an interior of the holding rail 58 and from this into the bending beam member 48. The cover bar 138 is preferably inserted onto a recess 140 in the holding rail 58 provided for this and engages over an opening 142 of the section 136*b* of the supply channel 136 guided through the holding rail 58 so that the supply channel 136 continues with a section 136*a* in the cover bar 138, following the opening 142, as far as the sleeve 134.

It is therefore possible with this fixing device 110, for example controlled via a machine control, to fix the respectively inserted bending beam tool segments 32 in position.

I claim:

1. A bending machine for flat material, comprising:

a machine frame, a lower beam with a lower beam tool arranged on the machine frame, an upper beam with an upper beam tool arranged on the machine frame, said lower and upper beams being movable relative to one another for fixing a flat material in position, and a bending beam having a bending beam tool receiving portion adapted to be equipped with a bending beam tool and held on the machine frame so as to be pivotable about an axis of rotation, in order to bend the flat material when fixed in position by the upper beam and the lower beam, said bending beam tool receiving means being provided with an adjustable bowing device to effect bowing of the bending beam tool, said bowing device being adapted to support only one section of a foot of the bending beam tool when viewed in a bending direction, the sectional support of said foot causing said foot to abut a rear contact surface of the bending beam tool receiving means in a supported manner when bending forces occur.

2. A bending machine as defined in claim 1 wherein the foot experiences a momentum during the occurrence of the bending forces and while tilting about a contact surface formed by the bowing device, said momentum causing the foot to abut the rear contact surface of the bending beam tool receiving means when viewed in the bending direction.

3. A bending machine as defined in claim 1, wherein the bowing device supports the foot of the bending beam tool in a front region with respect to the bending direction.

4. A bending machine as defined in claim 1, wherein the region of the foot supported by the bowing device is arranged at a distance from a contact surface of the bending beam tool receiving means to the rear in relation to the bending direction.

5. A bending machine as defined in claim 1, wherein the bending beam tool comprises at least one bending beam tool segment.

6. A bending machine as defined in claim 1, wherein the bowing device has a first adjusting element movable in a direction towards said axis of rotation and having an adjustably bowable bearing surface for the foot of the bending beam tool.

7. A bending machine as defined in claim 6, wherein:

the first adjusting element interacts with a second adjusting element, and the bowing of the bearing surface of the first adjusting element is adjustable as a result of a movement of the adjusting elements relative to one another.

8. A bending machine as defined in claim 7, wherein the second adjusting element is movable in a direction parallel to said axis of rotation.

9. A bending machine as defined in claim 7, wherein the adjusting elements have adjusting surfaces abutting on one another, their inclination varying according to an amount of bowing that is achievable.

10. A bending machine as defined in claim 6, wherein the first adjusting element forming the bearing surface is built up from several segments arranged between guide members, said guide members guiding the segments in an adjusting direction transverse to said axis of rotation.

11. A bending machine as defined in claim 6, wherein the first adjusting element has a thickness corresponding approximately to the extension along the bending direction of the portion of the lower support surface of the foot which rests on the bearing surface.

12. A bending machine as defined in claim 7, wherein both adjusting elements have a thickness corresponding approximately to the extension along the bending direction of the portion of the lower support surface of the foot which rests on the bearing surface.

13. A bending machine as defined in claim 12, wherein the adjusting surfaces of at least one of the adjusting elements are produced from a piece of flat material by way of laser or water jet cutting.

14. A bending machine as defined in claim 13, wherein a guide surface of the second adjusting element is produced by way of laser or water jet cutting.

15. A bending machine as defined in claim 14, wherein the bearing surface of the first adjusting element is produced by way of laser or water jet cutting.

16. A bending machine as defined in claim 9, wherein the adjusting surfaces are designed in the shape of saw teeth and a center of each individual adjusting surface has the same respective distance from the guide surface and the bearing surface, respectively.

17. A bending machine as defined in claim 1, wherein the bending beam tool receiving means has a fixing device for the bending beam tool.

18. A bending machine as defined in claim 17, wherein the fixing device is actuatable.

19. A bending machine as defined in claim 18, wherein the fixing device is actuatable by a medium subject to pressure.

20. A bending machine as defined in claim 18, wherein the fixing device acts on the bending beam tool with an inclined surface in the direction of a bearing surface.

21. A bending machine as defined in claim 19, wherein a fixing member of the fixing device is acted upon by the medium subject to pressure.

22. A bending machine as defined in claim 21, wherein:

the fixing device has a pressure element extending in a longitudinal direction thereof, said pressure element having an elastically flexible wall so that any action on the pressure element by means of the medium subject to pressure leads to a force on the fixing member in the direction of an engagement with the foot of the bending beam tool.

23. A bending machine as defined in claim 21, wherein the fixing member comprises at least one fixing member segment.

* * * * *